United States Patent [19]

Boyle

[11] 4,106,660

[45] Aug. 15, 1978

[54] SPLASH PROOF DRINK-THROUGH BEVERAGE CONTAINER LID

[75] Inventor: Patrick T. Boyle, Baltimore, Md.

[73] Assignee: Maryland Cup Corporation, Owings Mills, Md.

[21] Appl. No.: 777,141

[22] Filed: Mar. 14, 1977

Related U.S. Application Data

[63] Continuation-in-part of Ser. No. 722,402, Sep. 13, 1976, Pat. No. 4,056,210, which is a continuation-in-part of Ser. No. 678,751, Apr. 21, 1976, abandoned.

[51] Int. Cl.[2] ..... A47G 19/22; B65D 7/24; B65D 41/32

[52] U.S. Cl. ..... 220/90.4; 229/7 R; 220/270; 220/266

[58] Field of Search ..... 220/90.4, 90.2, 89 A, 220/265, 266, 268, 269, 270; 229/7 R

[56] References Cited

U.S. PATENT DOCUMENTS

| | | | |
|---|---|---|---|
| 2,765,639 | 10/1956 | Bryant | 220/90.4 |
| 3,800,999 | 4/1974 | Serritella | 220/90.4 X |
| 3,994,411 | 11/1976 | Elfelt et al. | 220/90.4 |
| 4,056,210 | 11/1977 | Boyle | 220/90.4 |

*Primary Examiner*—William Price
*Assistant Examiner*—Steven M. Pollard
*Attorney, Agent, or Firm*—Birch, Stewart, Kolasch & Birch

[57] ABSTRACT

A sheet plastic lid for open-mouthed containers with a tear-away section therein is provided in which the tear-away section is removable by an upward and outward motion. A raised central area of the central web of the lid merges with the top surface of the rim or bead cavity and contains score lines defining a central tear tab and a major portion of the tear-away section, the lines diverging and stopping substantially inboard of the top surface of the bead cavity. Then with the lid on a container, when the tab is freed by penetrating the raised area at the innermost score lines it is pulled upward and outward to constrain the divergent score lines to effect predictable tears through the bead or rim cavity structure to remove the tear-away segment and leave the remainder of the lid intact on the container. The tear-away segment is provided with a relatively deep walled cavity defined therein such that the outermost wall of the cavity is juxtaposed with a container adjacent the rim thereof to render the tear-away segment replaceable on the container.

28 Claims, 3 Drawing Figures

SPLASH PROOF DRINK-THROUGH BEVERAGE CONTAINER LID

This application is a continuation-in-part of copending application Ser. No. 722,402 filed Sept. 13, 1976, now U.S. Pat. No. 4,056,210, of Patrick T. Boyle for SPLASH PROOF DRINK-THROUGH BEVERAGE CONTAINER LID. The previous application, in turn, is a continuation-in-part of prior application Ser. No. 678,751, filed Apr. 21, 1976 of the same inventor and having the same title, which prior application is now abandoned.

FIELD OF THE INVENTION

This invention relates to lids for disposable beverage containers and the like and more particularly to a plastic thermo-formed lid having a replaceable tear-away section therein to permit beverage to be consumed from the container by drinking through a tear-away section of the lid without removing the lid therefrom.

BACKGROUND OF THE INVENTION

Hot beverages and the like are constantly being served in environments in which an accidental spill can result in a painful injury, property damage, and other undersirable results.

The copending application Ser. No. 722,402 provides a thermo-formed lid with a tear-away section which permits a person to remove a portion of the lid and leave the bulk of the lid on the beverage container and drink through the torn-away segmental portion to give ready access to the contents of the container while substantially reducing the chance of spillage or splash by virtue of leaving the majority of the lid in place on the container while drinking. The entire disclosure of this copending application is incorporated by reference herein.

The present invention utilizes all the concepts and advantages of the copending application incorporated by reference herein and further provides a means whereby the grip of the lid on the rim of an associated container is materially enhanced, the segmental tear-away portion is replaceable on the container to substantially reclose the container and the lid is provided with an indexing means by which a container stacked on top of such a lid will be constrained to assume a predetermined and balanced position.

It is therefore an object of the present invention to provide a new and novel thermo-formed lid of plastic or plastic foam sheet material having a tear-away portion defined therein which will consistently tear off the lid and leave a predictable portion of the lid on the container and which will be replaceable on the container to fill the gap in the lid to substantially its original state.

It is another object of the present invention to provide a new and novel thermo-formed sheet plastic or foamed sheet plastic lid which will provide an enhanced grip upon the rim of an associated container closed thereby and at the same time provide the tear-away and replaceable segment to permit access to the contents of a container through a predetermined segment of the lid without removing the balance of the lid.

Yet another object of the present invention is to provide a new and novel tear-away and replaceable segment type lid having container stacking index means thereon.

These and other objects of the present invention will become more fully apparent with reference to the following specification and drawings which relate to a preferred embodiment of the invention.

SUMMARY OF THE INVENTION

A cup lid is made from polystyrene sheet or foamed material using standard thermo-forming procedures in the preferred embodiment of the present invention. The central portion of the lid is raised to the same level as and connected with the top of the bead cavity or sealing curl of the lid which fits over the upper lip or rim of a beverage container. The central web portion of the lid extending across the open mouth of the container includes arcuate depressed portions spaced about the periphery of the lid and a raised central portion or surface which has at least one segment thereof at the same elevation as the top of the bead or rim cavity of the lid such that it is merged with that surface over a predetermined angular segment of the periphery of the lid.

Within this predetermined angular segment of the periphery of the lid is defined a tear-out tab portion, by means of a pair of divergent cut lines which are substantially radially disposed on the lid and these cut lines are provided with an intermittent cut or score line tending to transversely join the two such that when the transverse cut line is caused to fracture beyond its extremities and merge with the divergent cut lines, the tear-out portion of the lid is defined and an upward and outward force thereon will cause the substantially divergent cut lines to tear-away through the top surface of the rim cavity and down through the skirt exterior to the cup rim or container rim, thereby separating the tear tap portion from the remainder of the lid.

Between the transverse cut line and the rim or skirt portion of the lid is a substantially steep walled cavity defined in the upper surface portion of the tear-out tab portion such that the outermost wall of the cavity and the skirt on the lid tend to pinch tightly on the rim of the container whereby leakage of the contents of the container is substantially inhibited and the tear-out portion is thereby made replaceable on the rim of the cup within the opening left in the lid by its removal.

Deep walled arcuate segments are defined immediately adjacent the rim cavity of the lid to provide internal wall portions substantially surrounding the interior of the container rim or bead. A vent opening is also provided diametrically opposed to the deep wall cavity defined in the tear-out section and a pair of arcuate bosses are upset in the upper surface of the lid and conform substantially to the internal peripheral dimensions of the bottom of an associated container such that when that container is stacked upon the upper surface of the lid, the container bottom is constrained by the arcuate bosses to assume a predetermined and stable position on top of the lid on the container beneath the same.

Substantially radial arms extend from certain portions of the raised central portion of the lid substantially opposed to the tear-away section for purposes of rigidity and these radial arm portions are relieved in a vertical sense by shallow arcuate depressions to enhance the grip of these particular interruptions in the bead cavity by partial bead cavities formed by the arcuate depressions.

DETAILED DESCRIPTION OF THE DRAWINGS

Figure 1:
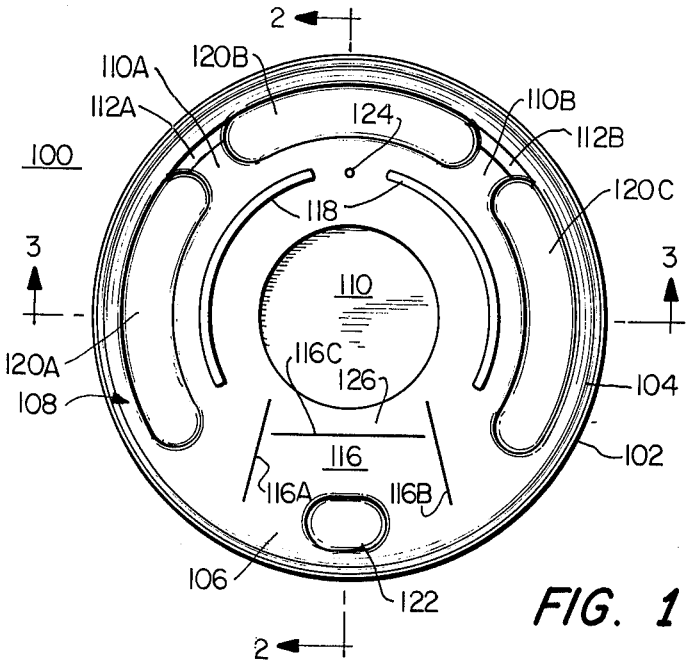
FIG. 1 is a top plan view of a preferred embodiment of the present invention illustrating the various features of the present invention.
Figure 2:
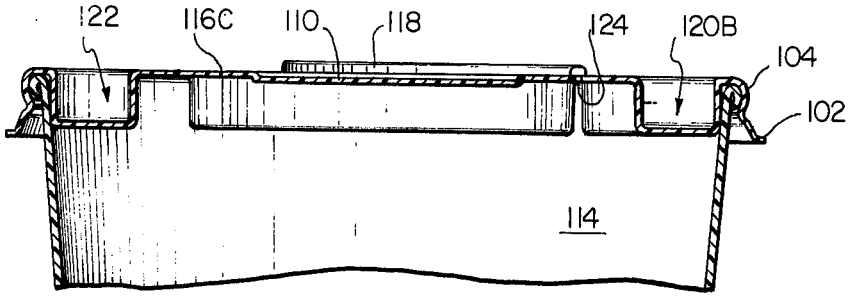
FIG. 2 is a cross section taken along line 2 of FIG. 1 illustrating the cross-sectional configuration of the lid on a container.
Figure 3:
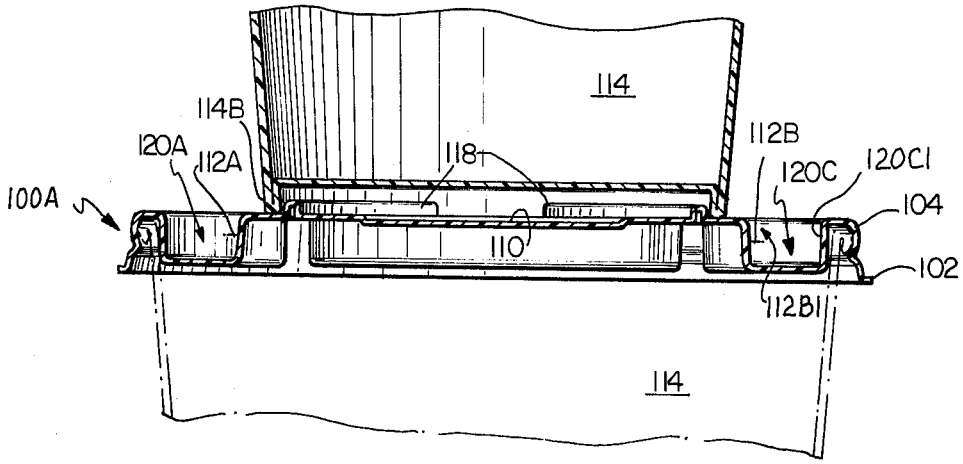
FIG. 3 is a partial cross section of a container which is stacked upon another lid and container.

Referring in detail to the drawings and with particular reference to FIGS. 1, 2 and 3, a lid 100 of the present invention is shown as including an outer rim portion 102 and an annular dependent skirt portion 104 which depends from the upper surface 106 of a bead cavity generally indicated at 108.

The lid 100 further includes a raised major central area 110 which is surrounded by a plurality of depressed arcuate peripheral steep walled cavity portions 120A, 120B and 120C. These arcuate cavities are in actuality defining internal wall portions of the bead cavity 108 in a peripheral amount coincident with the extent of the external steep walled portions of the said arcuate cavities 120A, 120B and 120C.

These arcuate cavities 120A, 120B and 120C are separated by substantially radially extending raised arm portions 110A and 110B on the upper surface 110 of the lid 100 and the continuity of the rim or bead receiving cavity 108 is substantially maintained across these radially extending arm shaped portions of the surface 110A and 110B by means of shallow arcuate channels 112A and 112B, respectively, across the said arms 110A and 110B immediately adjacent the interior surface of the container 114 associated with and affixed to the lid 100.

As best shown in FIG. 3, the deepest draw or wall portion 120C1 for example, of the arcuate channel 120C is alternated with the shallower draw or wall portion 112B1 of the arcuate slot 112B which are formed across the arm 110B and this same relationship exists between the cavities 120B and 120A which are joined by the shallower cavity 112A.

Thus, the continuity of the rim cavity 108 is substantially maintained over a major portion of the lid by the alternation of the deep and shallow draw of the arcuate depressions 120A, 112A, 120B, 112B and 120C to substantially surround the raised surface 110 of the lid with the exception of that area from which the tear-away segment 116 is to be removed.

The tear-away segment 116 is defined by a pair of divergent cut lines 116A and 116B which are all but joined transversely of a substantially intermediate symmetrical point thereof by a transverse interrupted cut line 116C.

Diametrically opposite the tear-away poriton 116 of the lid 100 is an arcuate boss which is formed as an upset and interrupted semicircular ridge 118 in the upper surface 110 of the lid 100.

Immediately adjacent the inner surface of the cup or container 114 in the tear-away section or tab 116 is a steep walled cavity or depression 122 having its outermost wall immediately adjacent the innermost wall of the container 114 such that the container rim R is gripped or sandwiched between the outer skirt 104 of the bead cavity 108 and the outer wall of the deep walled depression 122 defined in the tear-away segment 116. As a result, once the tear-away segment 116 has been removed from the lid 100, it is readily replaceable by the gripping action provided by the cavity 122 and the outer skirt 104 of the rim receiving cavity 108 of the lid 100.

The lid 100 is further provided with a vent hole 124 diametrically opposed to the deep walled 122 in the raised upper surface 110 of the lid 100. Thus, the lid may be utilized for either hot or cold drinks, interchangeable, by providing a vent hole for steam or for gases to escape from carbonated beverages.

In operation, the transverse cut line 116C and the inboard portions of the cut lines 116A and 116B provided a depressible flap portion 126 which may be pressed inwardly of the lid 100 to cause a continuing fracture along the axis of the cut line 116C into full intersection with the divergent cut lines 116A and 116B. This defines the inner most end of the tear-away segment 116A beneath which finger or thumb pressure may be applied upwardly and outwardly to cause the outermost portions of the transfer of the divergent cut lines 116A and 116B to fracture through the upper surface 106 of the rim receiving cavity 108 and thence outward and downward through the skirt 104 to thereby remove the tear-away segment from the lid 100.

After consuming a portion of the beverage in the container through the hole in the lid made by the removal of the tear-away segment 116, the user may, by retaining the tear-away segment 116, replace it by pressing the tear-away segment over the rim in the vicinity of the deep walled depression 122 to thereby cause the tear-away segment to regrip the rim of the container and maintain itself in position in its original configuration with the remainder of the lid 100, to thereby inhibit the spilling of the contents of the container while awaiting further consumption.

Furthermore, the radially extending arms 110A and 110B of the upper surface 110 of the center portion of the lid adds stiffness to the lid and strength while at the same time, the shallower arcuate grooves 112A and 112B joining the respective deep walled arcuate 120A, 120B and 120C through the said extending arms 110A and 110B maintain the integrity of the rim cavity of the lid over a major portion of the periphery thereof.

As can be seen in FIG. 2, the arcuate or semicircular boss 118 is engageable by the inner rim of the bottom 114B of the container 114 stacked on top of a lowermost lid 100A to centrally constrain the container 114 into proper stacked position on the lid 100A and tend to inhibit tilting or spilling of the container of 114 as a result of improper positioning.

As can be seen from the foregoing specification and drawings the present invention provides an improved tear-away lid structure in addition to those features already provided in such lids by the copending application Ser. No. 722,402, of Patrick Boyle for SPLASH PROOF DRINK THROUGH BEVERAGE CONTAINER LID filed September 13, 1976 and incorporated by reference herein.

The present invention may be modified as would occur to one of ordinary skill in the art without departing from the spirt and scope of the present invention.

It is claimed:

1. A friction fit sheet plastic lid for open mouthed containers having a peripheral lid receiving rim portion about the mouth thereof comprising:

a peripheral rim receiving cavity defined therein;

a central web bounded by said rim cavity;

a raised area formed in said central web;

an upper surface on said rim cavity at substantially the same height as said raised area and merging therewith over at least a predetermined peripheral portion; and a wedge shaped tear-away section having a tear-tab at its innermost extremity defined by score lines which diverge to substantially subtend said predetermined peripheral portion and which terminate substantially inboard of said upper surface of said bead cavity;

said tear-away section and said predetermined peripheral portion being removable from the remainder of said lid by an upward and outward force on said tear-tab;

said rim cavity being interrupted internally of said lid over said predetermined peripheral portion; and said tear-away segment including a substantially steepwalled cavity defined therein adjacent said rim cavity and having an outer wall cooperating with the outermost portion of the interrupter portion of said rim cavity to define a segmental rim gripping means for replaceably securing said tear-away section on the rim of an associated container.

2. A flexible plastic lid for open mouthed containers having an annular bead or rim defining the open mouth thereof, comprising:

a rim receiving annular bead cavity formed in the outer periphery of said lid and having an upper surface for overlying a container rim and a dependent annular skirt outboard of said upper surface;

a central web portion bounded by said bead cavity having a raised area defined therein connected to and at substantially the same level as said upper surface; and finite score line means formed in said raised area substantially transversely oriented there across to subtend a given peripheral portion of said bead cavity, the length of said score line means defining the transverse dimension of a tear-tab means in said raised area; and said tear-tab means in said raised area being responsive to an upward and outward pressure thereon at said score line means to cause said tear-tab means to predictably tear away from said raised area and through said bead cavity to remove said given peripheral portion;

said tear tab means having a substantially steepwalled cavity defined therein adjacent said dependent annular skirt and having an external wall cooperating with said skirt defining a container rim gripping means for removably supporting said tear-tab on a container rim independently of the remainder of said lid.

3. A friction fit sheet plastic lid for open mouthed containers having a peripheral lid receiving rim portion about the mouth thereof comprising:

a peripheral rim receiving cavity defined therein;

a central web bounded by said rim cavity;

a raised area formed in said central web;

an upper surface on said rim cavity at substantially the same height as said raised area and merging therewith over at least a predetermined peripheral portion; and a wedge shaped tear-away section having a tear-tab at its innermost extremity defined by score lines which diverge to substantially subtend said predetermined peripheral portion and which terminate substantially inboard of said upper surface of said bead cavity;

said tear-away section and said predetermined peripheral portion being removable from the remainder of said lid by an upward and outward force on said tear-tab;

said tear-away sections including container rim gripping means for replaceably securing said tear-away section on the rim of an associated container independently of the remainder of said lid.

4. A flexible plastic lid for open mouthed containers having an annular bead or rim defining the open mouth thereof, comprising:

a rim receiving annular bead cavity formed in the outer periphery of said lid and having an upper surface for overlying a container rim and a dependent annular skirt outboard of said upper surface;

a central web portion bounded by said bead cavity having a raised area defined therein connected to and at substantially the same level as said upper surface; and finite score line means formed in said raised area substantially transversely oriented there across to subtend a given peripheral portion of said bead cavity, the length of said score line means defining the transverse dimension of a tear tab means in said raised area; and said tear-tab means in said raised area being responsive to an upward and outward pressure thereon at said score line means to cause said tear-tab means to predictably tear away from said raised area and through said bead cavity to remove said given peripheral portion;

said tear-away sections including container rim gripping means for replaceably securing said tear-away section on the rim of an associated container independently of the remainder of said lid.

5. A friction fit sheet plastic lid for open mouthed containers having a peripheral lid receiving rim portion about the mouth thereof comprising:

a peripheral rim receiving cavity defined therein;

a central web bounded by said rim cavity;

a raised area formed in said central web;

an upper surface on said rim cavity at substantially the same height as said raised area and merging therewith over at least a predetermined peripheral portion; and a tear-away section having a tear-tab at its innermost extremity defined by a score line configuration which substantially subtends said predetermined peripheral portion and which terminates substantially inboard of said upper surface of said bead cavity;

said tear-away section and said predetermined peripheral portion being removable from the remainder of said lid by an upward and outward force on said tear-tab;

said tear-away sections including container rim gripping means for replaceably securing said tear-away section on the rim of an associated container independently of the remainder of said lid.

6. The invention defined in claim 5, wherein said rim gripping means comprises a steep-walled depression defined in said raised surface of said tear-away segment immediately adjacent said rim cavity.

7. The invention defined in claim 5, wherein said score line configuration comprises a straight cut through said raised area with outboard ends turned toward said bead cavity to define the direction of predictable tear lines through said raised area and said bead cavity.

8. The invention defined in claim 1, wherein said lid further comprises upstanding arcuate boss means in said raised area substantially diametrically opposite said tear-away segment and conformally shaped to receive and index on said raised area the bottom of container stacked thereon.

9. The invention defined in claim 2, wherein said lid further comprises upstanding arcuate boss means in said raised area substantially diametrically opposite said tear-away segment and conformally shaped to receive and index on said raised area the bottom of container stacked thereon.

10. The invention defined in claim 3, wherein said lid further comprises upstanding arcuate boss means in said raised area substantially diametrically opposite said tear-away segment and conformally shaped to receive and index on said raised area the bottom of container stacked thereon.

11. The invention defined in claim 4, wherein said lid further comprises upstanding arcuate boss means in said raised area substantially diametrically opposite said tear-away segment and conformally shaped to receive and index on said raised area the bottom of container stacked thereon.

12. The invention defined in claim 5, wherein said lid further comprises upstanding arcuate boss means in said raised area substantially diametrically opposite said tear-away segment and conformally shaped to receive and index on said raised area the bottom of container stacked thereon.

13. The invention defined in claim 6, wherein said lid further comprises upstanding arcuate boss means in said raised area substantially diametrically opposite said tear-away segment and conformally shaped to receive and index on said raised area the bottom of container stacked thereon.

14. The invention defined in claim 7, wherein said lid further comprises upstanding arcuate boss means in said raised area substantially diametrically opposite said tear-away segment and conformally shaped to receive and index on said raised area the bottom of container stacked thereon.

15. The invention defined in claim 1, wherein said lid further includes alternating, arcuate peripherally disposed cavities of relatively deep and shallow draft, respectively, bounding said raised central area and defining a substantially continuous cup rim receiving cavity extending from both sides of said tear-away segment around the remainder of said lid while simultaneously enhancing the stiffness of said lid.

16. The invention defined in claim 2, wherein said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

17. The invention defined in claim 3, wherein said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

18. The invention defined in claim 4, wherein said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

19. The invention defined in claim 5, wherein said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

20. The invention defined in claim 6, wherein said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

21. The invention defined in claim 7, wherein said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

22. The invention defined in claim 1, wherein said lid further comprises upstanding arcuate boss means in said raised area substantially diametrically opposite said tear-away segment and conformally shaped to receive and index on said raised area the bottom of container stacked thereon; and said lid further includes alternating, arcuate peripherally disposed cavities of relatively deep and shallow draft, respectively, bounding said raised central area and defining a substantially continuous cup rim receiving cavity extending from both sides of said tear-away segment around the remainder of said lid while simultaneously enhancing the stiffness of said lid.

23. The invention defined in claim 2, wherein said lid further comprises upstanding arcuate boss means in said raised area substantially diametrically opposite said tear-away segment and conformally shaped to receive and index on said raised area the bottom of container stacked thereon; and said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

24. The invention defined in claim 3, wherein said lid further comprises upstanding arcuate boss means in said raised area substantially diametrically opposite said tear-away segment and conformally shaped to receive the index on said raised area the bottom of container stacked thereon; and said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

25. The invention defined in claim 4, wherein said lid further comprises upstanding arcuate boss means in said raised area substantially diametrically opposite said tear-away segment and conformally shaped to receive the index on said raised area the bottom of container stacked thereon; and said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

26. The invention defined in claim 5, wherein said lid further comprises upstanding arcuate boss means in said raised area substantially diametrically opposite said tear-away segment and conformally shaped to receive the index on said raised area the bottom of container stacked thereon; and said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

27. The invention defined in claim 6, wherein said lid further comprises upstanding arcuate boss means in said raised area substantially diametrically opposite said tear-away segment and conformally shaped to receive the index on said raised area the bottom of container stacked thereon; and said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

28. The invention defined in claim 7, wherein said lid further comprises upstanding arcuate boss means in said raised area substantially diametrically opposite said tear-away segment and conformally shaped to receive the index on said raised area the bottom of container stacked thereon; and said lid further includes alternating, arcuate peripherally disposed cavities of relatively deep and shallow draft, respectively, bounding said raised central area and defining a substantially continous cup rim receiving cavity extending from both sides of said tear-away segment around the remainder of said lid while simultaneously enhancing the stiffness of said lid.

* * * * *